US007256673B2

(12) United States Patent
Okumura et al.

(10) Patent No.: US 7,256,673 B2
(45) Date of Patent: Aug. 14, 2007

(54) COIL ASSEMBLY INCLUDING COMMON-MODE CHOKE COIL

(75) Inventors: Takeshi Okumura, Chuo-ku (JP); Hiroshi Suzuki, Chuo-ku (JP); Toshihiro Kuroshima, Chuo-ku (JP); Eizou Hara, Sakata (JP); Katsumi Saito, Chuo-ku (JP); Yuichiro Igarashi, Sakata (JP)

(73) Assignee: TDK Corporation, Tokyo (JP)

( * ) Notice: Subject to any disclaimer, the term of this patent is extended or adjusted under 35 U.S.C. 154(b) by 66 days.

(21) Appl. No.: 11/327,319

(22) Filed: Jan. 9, 2006

(65) Prior Publication Data

US 2006/0170526 A1 Aug. 3, 2006

(30) Foreign Application Priority Data

Jan. 31, 2005 (JP) ..... 2005-022635
Mar. 18, 2005 (JP) ..... 2005-079872

(51) Int. Cl.
*H01F 27/02* (2006.01)

(52) U.S. Cl. ..... 336/83; 336/200; 336/192

(58) Field of Classification Search ..... 336/83, 336/200, 223, 192, 65, 232
See application file for complete search history.

(56) References Cited

U.S. PATENT DOCUMENTS 6,522,230 B2 * 2/2003 Hanato et al. ..... 336/83
7,078,988 B2 * 7/2006 Suzuki et al. ..... 333/181
7,113,067 B2 * 9/2006 Hirai et al. ..... 336/192
2001/0033218 A1 * 10/2001 Murata et al. ..... 336/83
2002/0057160 A1 * 5/2002 Hanato et al. ..... 336/83

FOREIGN PATENT DOCUMENTS

| | | | |
|---|---|---|---|
| JP | 10064737 A | * | 3/1998 |
| JP | 11204346 A | * | 7/1999 |
| JP | A 2000-208331 | | 7/2000 |
| JP | A 2002-313646 | | 10/2002 |
| JP | A 2003-077730 | | 3/2003 |
| JP | A 2003-133148 | | 5/2003 |
| JP | A 2003-158021 | | 5/2003 |
| JP | A 2004-146671 | | 5/2004 |
| JP | A 2004-311560 | | 11/2004 |
| JP | A 2004-356473 | | 12/2004 |

* cited by examiner

*Primary Examiner*—Anh Mai
(74) *Attorney, Agent, or Firm*—Oliff & Berridge, PLC

(57) ABSTRACT

A coil assembly for reducing variations in characteristic impedance includes a winding section having a first surface and a second surface on the opposite side of the winding section from the first surface, a plurality of first protrusions provided on the first surface, and a plurality of second protrusions provided on the second surface. These protrusions are identical in shape to each other and are arrayed linearly on their respective surfaces so that the first protrusions are offset from the second protrusions. Two conducting wires are wound between neighboring protrusions such that one wire contacts one of the neighboring protrusions, while the other wire contacts the other neighboring protrusion.

16 Claims, 2 Drawing Sheets

COIL ASSEMBLY INCLUDING COMMON-MODE CHOKE COIL

BACKGROUND OF THE INVENTION

The present invention relates to a coil assembly such as a common-mode choke coil.

Recently, high-frequency transmission signals are becoming commonplace in such interface standards as the USB 2.0 standard, a high-speed interface for personal computers and the like, and the HTMI standard, a digital video and audio input/output interface for digital video and the like. In accordance with using high-frequency transmission signals, these standards employ a differential transmission method that reduces the effects of noise interference and signal error by transmitting signals in opposite phase along two conducting wires.

In reality, however, common-mode noise currents are often generated due to differences in the communication properties of the two conducting wires, for example. In such a case, the wires may act as antennas and radiate noise. Japanese patent application publication No. 2003-133148 proposes one common-mode choke coil for reducing this noise.

Further, in interfaces employing high-frequency transmission signals, in addition to inductance, the line-to-line capacitance of the common-mode choke coils remarkably influences the characteristic impedance of the coils.

SUMMARY OF THE INVENTION

However, the present inventors recognized that the common-mode choke coil disclosed in Japanese patent application publication No. 2003-133148 has no parts for positioning the conducting wires when winding the wires around the winding section. Therefore, the winding is not uniform, producing variations in line-to-line capacitance that cause variations in the characteristic impedance of the common-mode choke coil.

To reduce these variations, the present inventors found that the line-to-line capacitance changes based on the distance between the two conducting wires. Therefore, it is an object of the present invention to provide. a coil assembly that can reduce variations in characteristic impedance by maintaining a uniform interval between conducting wires.

This and other objects of the present invention will be attained by providing a coil assembly including an improved core, two conducting wires, and electrodes. The core includes a columnar winding section having a winding surface, and flanges disposed on both ends of the winding section. The two conducting wires are wound around the winding surface of the core. The electrodes are disposed on the flanges of the core to be connected to the two conducting wires. The winding section has a plurality of protrusions protruding from the winding surface. The two conducting wires are wound about the winding surface so as to pass between neighboring protrusions while remaining separated from each other.

DESCRIPTION OF THE PREFERRED EMBODIMENTS

Figure 1:
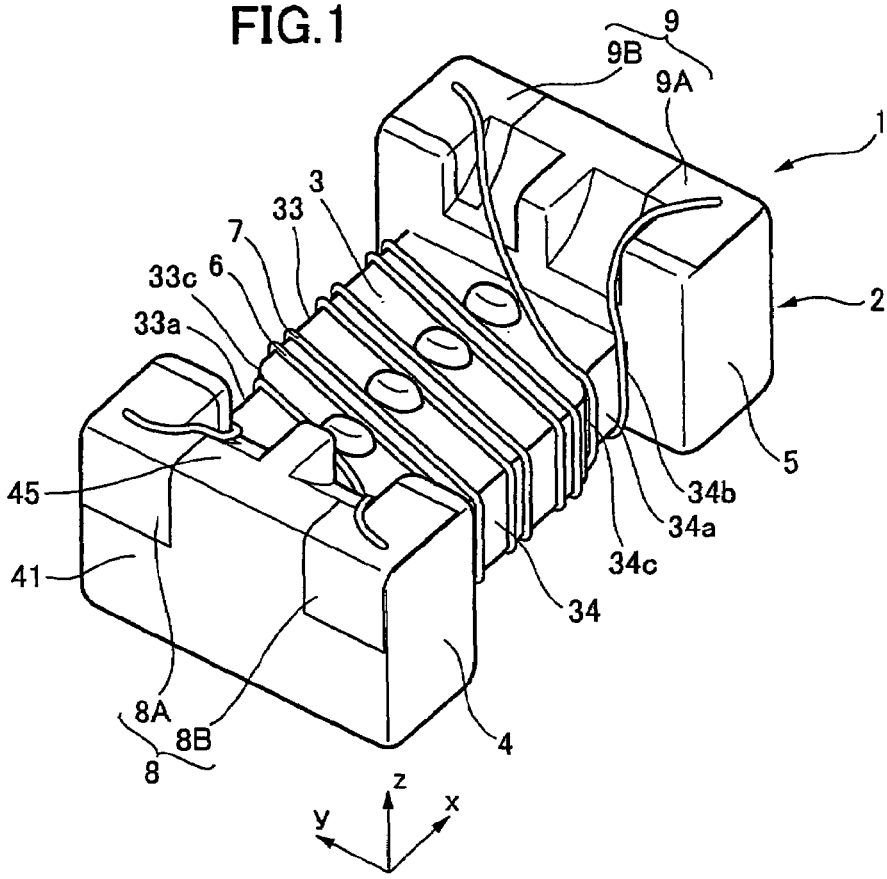
FIG. 1 is a perspective view of a common-mode choke coil according to a preferred embodiment of the present invention.

A common-mode choke coil 1 which is one of the examples of a coil assembly according to a preferred embodiment of the present invention will be described while referring to FIGS. 1 through 4. As shown in FIG. 1, the common-mode choke coil 1 includes a core 2, a first conducting wire 6, a second conducting wire 7, and a first electrode part 8, and a second electrode part 9.

Figure 2:
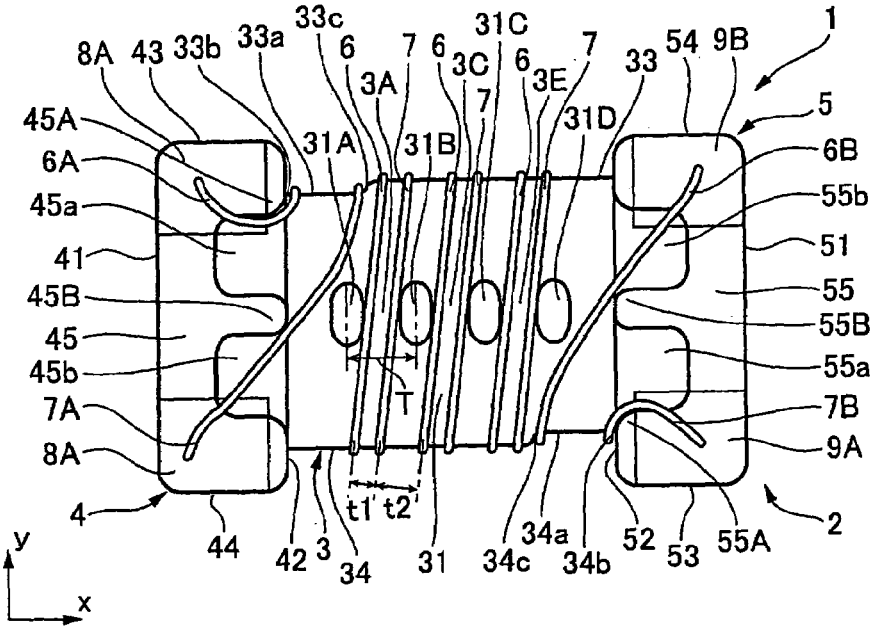
FIG. 2 is a plan view of the common-mode choke coil according to the preferred embodiment.
Figure 3:
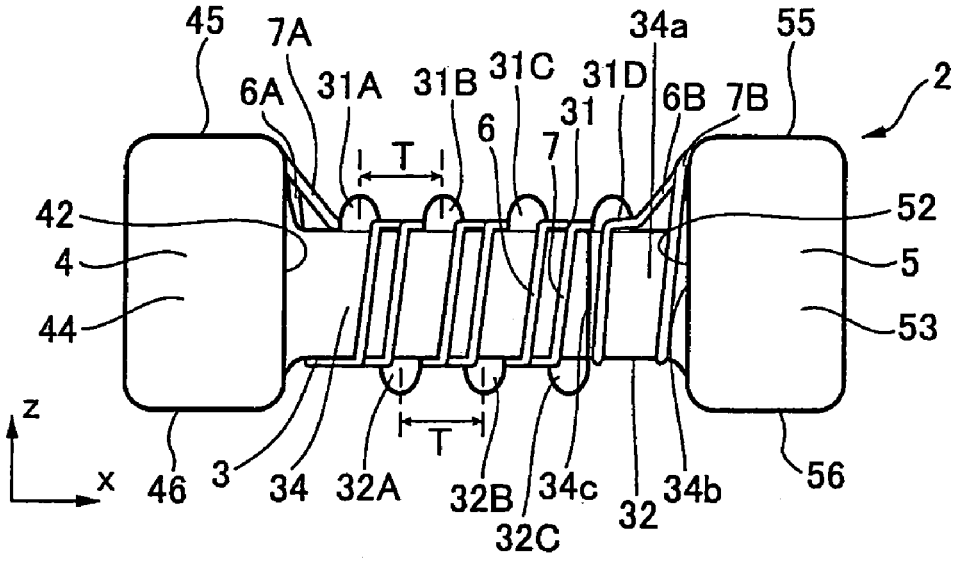
FIG. 3 is a side view of the common-mode choke coil according to the preferred embodiment.

The core 2 includes a winding section 3, a first flange 4, and a second flange 5. The winding section 3 is formed of a magnetic body and has a substantially rectangular-shaped cross-section in a plane orthogonal to a longitudinal direction of the winding section 3. The first flange 4 and second flanges 5 are disposed one on either longitudinal end of the winding section 3 and have shapes nearly identical with each other. As shown in FIG. 2, the longitudinal direction of the winding section 3, which is the winding direction for the conducting wires 6 and 7, is defined as an x-direction, and a latitudinal direction of the winding section 3, equivalent to the direction connecting a first electrode 8A to a second electrode 8B described later, is defined as a y-direction. As shown in FIG. 3, a thickness direction of the winding section 3 orthogonal to the x-direction and the y-direction is defined as a z-direction.

As shown in FIGS. 2 and 3, the winding section 3 is configured of a first surface 31 extending in the widthwise direction (x-y direction), a second surface 32 on the side of the winding section 3 opposite the first surface 31, and a first side surface 33 and a second side surface 34 extending in the thickness direction (x-z direction) between the first surface 31 and second surface 32. The first surface 31 and second surface 32 are substantially parallel to each other, and the first side surface 33 and second side surface 34 are substantially parallel to each other. Hence, a cross-section of the first side surface 33 along the y-z plane is substantially rectangular in shape.

Figure 4:
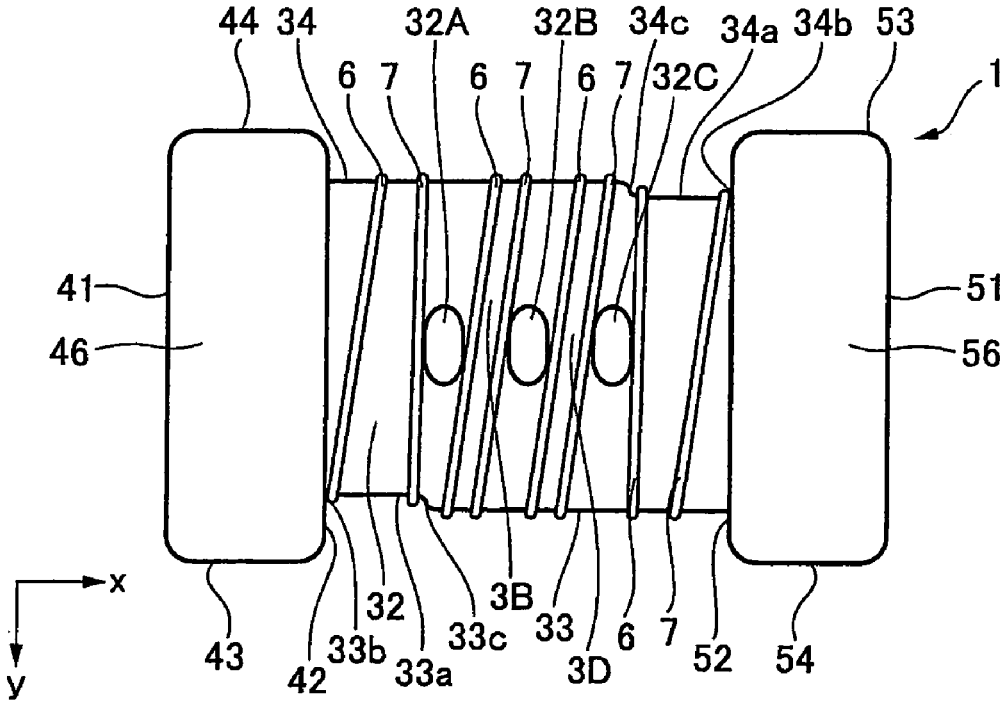
FIG. 4 is a bottom view of the common-mode choke coil according to the preferred embodiment.

As shown in FIGS. 1, 2 and 4, a first notch 33*a* is formed in the first side surface 33 near an area that the first side surface 33 intersects with a back surface 42 described later. The first notch 33*a* is a slight depression in the first side surface 33 and is formed across nearly the entire z-direction. A first corner 33*b* is provided at a juncture between the first notch 33*a* and the back surface 42. A second corner 33*c* is formed at a juncture between the first side surface 33 and the first notch 33*a* as a step part. Similarly, as shown in FIGS. 1, 2 and 4, a second notch 34*a* identical to the first notch 33*a* is formed in the second side surface 34 where the second side surface 34 intersects a back surface 52 described later. A third corner 34*b* is provided at a juncture between the second notch 34*a* and the back surface 52. A fourth corner 34*c* is formed at a juncture between the second side surface 34 and second notch 34*a* as a step part.

As shown in FIGS. 2 and 3, first protrusions 31A-31D are arrayed linearly at regular intervals in the x-direction across the approximate center region of the first surface 31 with respect to the y-direction. As shown in FIGS. 3 and 4, second protrusions 32A-32C are disposed substantially in the center of the second surface 32 with respect to the y-direction and arrayed linearly at regular intervals in the x-direction. All of the first protrusions 31A-31D and second protrusions 32A-

32C have substantially the same shape, tapering from a base end toward a top end such that the cross-sectional area of the base end is greater than that of the top end (see FIG. 3). Further, these protrusions are shaped into a gentle mountain shape avoiding overhanging configuration as viewed in z-direction. The surfaces of the protrusions are sloped with respect to the surfaces of the winding section 3.

As shown in FIG. 3, the second protrusion 32A is positioned substantially between the first protrusions 31A and 31B in the x-direction. As shown in FIGS. 2 and 4, a first region 3A is defined between the first protrusions 31A and 31B, a second region 3B is defined between the second protrusions 32A and 32B, a third region 3C is defined between the first protrusions 31B and 31C, a fourth region 3D is defined between the second protrusions 32B and 32C, and a fifth region 3E is defined between the first protrusions 31C and 31D.

As shown in FIGS. 2 and 3, the first flange 4 is substantially shaped as a rectangular parallelepiped formed by a front surface 41 and back surface 42 orthogonal to the x-direction, a first side surface 43 and second side surface 44 orthogonal to the y-direction, and a top surface 45 and a bottom surface 46 orthogonal to the, z-direction. Similarly, the second flange 5 is substantially shaped as a rectangular parallelepiped formed by a front surface 51 and back surface 52 orthogonal to the x-direction, a first side surface 53 and second side surface 54 orthogonal to the y-direction, and a top surface 55 and a bottom surface 56 orthogonal to the z-direction.

As shown in FIG. 2, a pair of first and second grooves 45*a* and 45*b* is formed in the top surface 45 sloping from a substantially central position on the top surface 45 in the x-direction toward the winding section 3. The first and second grooves 45*a* and 45*b* are symmetrical about a line in the x-direction passing through a central point in the top surface 45 with respect to the y-direction. A first retaining part 45A is defined as a step formed by the first groove 45*a* on the side of the first groove 45*a* near the first side surface 33 in the y-direction. A second retaining part 45B is defined as a step formed between the second groove 45*b* and the first groove 45*a*.

Similarly, a pair of third and fourth grooves 55*a* and 55*b* is formed in the top surface 55 of the second flange 5 sloping from a substantially central position on the top surface 55 in the x-direction toward the winding section 3. The third and fourth grooves 55*a* and 55*b* are symmetrical about a line in the x-direction passing through a central point in the top surface 55 with respect to the y-direction. A third retaining part 55A is defined as a step formed by the third groove 55*a* on the side of the third groove 55*a* near the second side surface 34 in the y-direction. A fourth retaining part 55B is defined as a step formed between the fourth groove 55*b* and the third groove 55*a*.

The first electrode part 8 includes a first electrode 8A and a second electrode 8B those arrayed in the y-direction. The first electrode 8A is on the first side surface 43 side and a second electrode 8B is on the second side surface 44 side. As shown in FIG. 1, the first and second electrodes 8A and 8B are formed by electroplating either side of the top surface 45 and front surface 41. A portion of the first electrode 8A is formed in the first groove 45*a* in the top surface 45. Similarly, a portion of the second electrode 8B is formed in the second groove 45*b*. The top surface 45 portion of the first electrode part 8 is the part that connects with the conducting wires 6 and 7.

As shown in FIG. 2, the second electrode part 9, like the first electrode part 8, includes a third electrode 9A on the first side surface 53 side and a fourth electrode 9B on the second side surface 54 side and aligned in the y-direction. The third and fourth electrodes 9A and 9B are formed by electroplating either side of the top surface 55 and front surface 51. A portion of the third electrode 9A is formed in the third groove 55*a* in the top surface 55. Similarly, a portion of the fourth electrode 9B is formed in the fourth groove 55*b*. The top surface 55 portion of the second electrode part 9 connects with the conducting wires 6 and 7. The second flange 5 is formed nearly identical to the first flange 4 and is symmetrical to the first flange 4 across the winding section 3. Therefore, the direction connecting the first electrode 8A to the second electrode 8B is substantially the same as the direction connecting the third electrode 9A to the fourth electrode 9B.

As shown in FIG. 2, the first conducting wire 6 has ends 6A and 6B. With the end 6A connected to the first electrode 8A, the first conducting wire 6 is disposed in the first groove 45*a* and engaged with the first retaining part 45A. The first conducting wire 6 is then led over the back surface 42 toward the first notch 33*a* side, and is run through the first notch 33*a* along the first corner 33*b*. From this point the first conducting wire 6 begins its winding around the winding section 3.

The second conducting wire 7 includes ends 7A and 7B. With the end 7A connected to the second electrode 8B, the second conducting wire 7 is disposed in the second groove 45*b* and engaged with the second retaining part 45B. The second conducting wire 7 then extends toward the first notch 33*a*, passing near the first protrusion 31A on the first surface 31, and is led through the first notch 33*a* along the second corner 33*c*. From this point the second conducting wire 7 begins its winding around the winding section 3. By winding the first conducting wire 6 along the first corner 33*b* and the second conducting wire 7 along the second corner 33*c*, the start positions for winding the conducting wires 6 and 7 can be accurately regulated so that the windings are less likely to shift to become in disarray. Further, the conducting wires 6 and 7 can be accurately run from their points of connection to the first notch 33*a* by engaging the conducting wires 6 and 7 with the first retaining part 45A and second retaining part 45B to lead these wires to the first notch 33*a*, respectively.

As shown in FIG. 4, the second conducting wire 7 disposed along the second corner 33*c* is wound over the surface of the second surface 32 on the first flange 4 side of the second protrusion 32A and is wound over the second side surface 34 to the first surface 31 side. Next, as shown in FIG. 2, the second conducting wire 7 wound up from the second side surface 34 passes through the first region 3A of the first surface 31 so as to contact the first protrusion 31B and is subsequently wound over the first side surface 33 to the second surface 32 side.

Further, as shown in FIG. 4, the first conducting wire 6 disposed along the first corner 33*b* is subsequently run over the second surface 32, and wound over the second side surface 34 to the first surface 31 side. Next, as shown in FIG. 2, the first conducting wire 6 wound up from the second side surface 34 passes through the first region 3A of the first surface 31 so as to contact the first protrusion 31A and is subsequently wound around to the second surface 32 side.

The interval between center points of the first protrusion 31A and first protrusion 31B in the x-direction is a fixed distance T. Since the first protrusions 31A and 31B have the same shape, the distance between the conducting wires 6 and 7 within the first region 3A is maintained at a uniform distance t1.

As shown in FIG. 4, the second conducting wire 7 wound through the first region 3A and over the first side surface 33 to the second surface 32 is then run through the second region 3B on the second surface 32 so as to contact the second protrusion 32B, and is subsequently wound over the second side surface 34 to the first surface 31. The first conducting wire 6 also wound through the first region 3A and over the first side surface 33 to the second surface 32 side is run through the second region 3B on the second surface 32 so as to contact the second protrusion 32A, and is subsequently wound over the second side surface 34 to the first surface 31 side.

The second region 3B is formed substantially identical to the first region 3A so that the distance between center points of the second protrusions 32A and 32B is equivalent to the distance between center points of the first protrusions 31A and 31B, that is, the distance T. Since the second protrusions 32A and 32B are identical in shape to the first protrusion 31A, the second region 3B is substantially identical in shape to the first region 3A. Accordingly, the distance between the conducting wires 6 and 7 in the second region 3B is identical to the distance between the conducting wires 6 and 7 in the first region 3A, that is, t1.

Similarly, since the third region 3C, fourth region 3D, and fifth region 3E are also formed substantially identical to the first region 3A, the distance between the conducting wires 6 and 7 in the regions 3C, 3D, and 3E are maintained at the same value t1. Hence, when winding the conducting wires 6 and 7 about the winding section 3 through these regions, the distance in the x-direction is maintained at a uniform t1 so that the same space is maintained between the conducting wires.

As shown in FIG. 2, the first region 3A, third region 3C, and fifth region 3E on the first surface 31 are partitioned by the first protrusions 31B and 31C having the same shape. As shown in FIG. 4, the second region 3B and fourth region 3D on the second surface 32 are partitioned by the second protrusion 32B. Since all of the first protrusions 31A-31D and second protrusions 32A-32C have substantially the same shape, the distance between neighboring regions is substantially identical.

Further, the conducting wires 6 and 7 are arranged in these regions so as to contact the protrusions partitioning the regions. Therefore, the distance between a group of conducting wires 6 and 7 arranged in the first region 3A and the group of conducting wires 6 and 7 arranged in the third region 3C is t2, while the distance between the group of conducting wires 6 and 7 in the third region 3C and the group of the conducting wires 6 and 7 in the fifth region 3E is a substantially equivalent t2. Further, the distance between the group of conducting wires 6 and 7 in the first region 3A and the group of conducting wires 6 and 7 in the third region 3C is substantially equivalent to the distance between the group of conducting wires 6 and 7 in the second region 3B and the group of conducting wires 6 and 7 in the fourth region 3D.

Therefore, when winding the conducting wires 6 and 7 around the winding section 3, the distance between each turn measured for the conducting wires 6 and 7 as a set is at least the fixed value from the first region 3A to the fifth region 3E, that is, t2.

As shown in FIG. 4, the second conducting wire 7 extending from the fifth region 3E over the first side surface 33 is wound over to the second surface 32 side. The second conducting wire 7 extends over the second surface 32 toward the second notch 34*a* and is run to the position of the third corner. 34*b*. Subsequently, the second conducting wire 7 is led through the second notch 34*a* along the third corner 34*b*. As shown in FIG. 2, the second conducting wire 7 is then disposed on the back surface 52 and engaged with the third retaining part 55A. The second conducting wire 7 runs through the third groove 55*a* and extends to the third electrode 9A side with the end 7B connected to the third electrode 9A.

As shown in FIG. 4, the first conducting wire 6 extending from the fifth region 3E over the first side surface 33 is wound over to the second surface 32 side. The first conducting wire 6 extends over the second surface 32 along the second flange 5 side of the second protrusion 32C toward the second notch 34*a* and is positioned at the fourth corner 34*c*. Subsequently, the first conducting wire 6 is led through the second notch 34*a* along the fourth corner 34*c*. As shown in FIG. 2, the first conducting wire 6 is run over the first surface 31 in close proximity to the first protrusion 31D and is engaged with the fourth retaining part 55B. The first conducting wire 6 is led through the fourth groove 55*b* and extends to the fourth electrode 9B side so that the end 6B is connected to the fourth electrode 9B.

By winding the first conducting wire 6 along the fourth corner 34*c* toward the connection point and winding the second conducting wire 7 along the third corner 34*b* toward its connection point, the ending positions of the conducting wires 6 and 7 are precisely defined. Further, by engaging the conducting wires 6 and 7 extending from the second notch 34*a* with the fourth retaining part 55B and third retaining part 55A, respectively, for connecting the ends of the conducting wires 6 and 7 to the connection points, precise positioning of the end portions of the conducting wires 6 and 7 between the second notch 34*a* and the connection points is achievable.

Further, when winding the conducting wires 6 and 7 around the winding section 3, there may be cases in which, for example, the first conducting wire 6 is wound on the top surface or sloping surface of the first protrusion 31A. However, since the surface of the first protrusion 31A is sloped, the first conducting wire 6 slides down the surface of the first protrusion 31A and falls at the foot or base of the first protrusion 31A where the first protrusion 31A intersects the first surface 31. Hence, by winding the conducting wires 6 and 7 about the winding section 3 so as to catch slightly on the first protrusions 31A-31D and the second protrusions 32A-32C, the conducting wires 6 and 7 can be wound so as to properly contact the feet of these protrusions.

In the common-mode choke coil 1 having the construction described above, the distance between the conducting wires 6 and 7 is maintained at a substantially uniform value t1, while the distance of one turn for the group of conducting wires 6 and 7 is maintained at a substantially uniform value t2. Hence, variation in property among produced common-mode choke coils can be reduced.

Since the common-mode choke coil 1 described above can accurately regulate the starting positions and ending positions of the conducting wires 6 and 7 wound about the winding section 3, the structure of the common-mode choke coil 1 can reduce variations in properties among different products. Further, in the common-mode choke coil 1 described above, the first and second flanges 4 and 5 are shaped identical to one another and are symmetrical about a center position of the winding section 3 in the x-y plane. Accordingly, when manufacturing the common-mode choke coil 1, the pair of flanges provided on both ends of the winding section 3 can both be the first flange 4. Hence, it is not necessary to align the core 2 in the x-direction when manufacturing the common-mode choke coil 1, eliminating unnecessary steps and improving productivity.

Since the first notch 33*a* is formed along the juncture between the winding section 3 and the first flange 4, the conducting wires 6 and 7 can be wound from the end of the winding section 3 on the first flange 4 side, effectively utilizing the winding section 3. Further, by forming the juncture between the first flange 4 and winding section 3 as a portion of the first notch 33*a*, the shape of the core 2 is simplified, facilitating molding of the core 2.

Further, since the second notch 34*a* is formed along the juncture between the winding section 3 and second flange 5, the conducting wires 6 and 7 can be wound all the way to the end of the winding section 3 on the second flange 5 side, thereby more effectively utilizing the winding section 3.

The line-to-line capacitance of the common-mode choke coil 1 varies according to the distance between the conducting wires 6 and 7 and the distance between each turn of the set of conducting wires 6 and 7. In this standpoint, the common-mode choke coil 1 of the preferred embodiment maintains these distances at uniform values for each product. Thus, a common-mode choke coil having substantially uniform line-to-line capacitance can be provided. Further, the characteristic impedance of the common-mode choke coil varies according to line-to-line capacitance. In this standpoint, the variation of line-to-line capacitance among products is reduced by maintaining the distance between the conducting wires 6 and 7 at a uniform t1 and the distance between each turn of the set of conducting wires 6 and 7 at a uniform t2. Thus, a common-mode choke coil with uniform characteristic impedance for each product can be provided. Accordingly, the resultant common-mode choke coil provides less variation in characteristic impedance among products and is capable of reliably removing specific frequencies.

Next, several modifications to the preferred embodiment will be described. The protrusions can be formed only on the first surface 31 or only on the first side surface 43. Alternatively, protrusions can be provided on each of the first surface 31, second surface 32, and first side surface 43. By providing protrusions on at least one surface among the four surfaces and winding the conducting wires 6 and 7 at the feet of these protrusions, it is possible to maintain a uniform distance between the conducting wires 6 and 7 and between each turn of the set of conducting wires 6 and 7.

When providing both the first and second protrusions on the first surface 31 and first side surface 33, respectively, it is possible to maintain a uniform distance between the conducting wires 6 and 7 and between each turn of the set of conducting wires 6 and 7 by displacing the first and second protrusions at about ¼ pitch in the x-direction. Similarly, the first and second protrusions may be provided on the second surface 32 and second side surface 34, respectively.

Further, in the preferred embodiment described above, both the first and second protrusions are provided at equal intervals in a direction parallel to the x-direction. However, it is also possible, for example, to offset the first protrusions on the first surface 31 in the y-direction. In the latter case, the positions of the first protrusions should be calculated in advance to maintain a uniform distance between the conducting wires 6 and 7 and between each turn of the set of conducting wires 6 and 7.

Further, the winding section 3 may have a polygonal cross-section and include the first surface 31. A plurality of first protrusions of identical shape may be provided on the first surface 31 and arranged linearly at fixed intervals in a direction from one of flange toward the other flange.

With this construction, it is possible to maintain a uniform distance between each turn of the conducting wires 6 and 7 and a uniform distance between the set of conducting wires 6 and 7 when winding the conducting wires 6 and 7 about the winding section 3. Since the line-to-line capacitance varies according to the distance between the conducting wires 6 and 7 and the distance between each turn of the set of conducting wires 6 and 7, this construction can maintain a uniform line-to-line capacitance of the conducting wires on the winding section 3.

Further, the winding section 3 having a polygonal cross-section has a second surface, and the protrusions include a plurality of second protrusions provided on the second surface in addition to the first protrusions provided on the first surface. The second protrusions are identical in shape to each other and to the first protrusions and are arranged linearly at fixed intervals on the second surface in a direction from one flange toward the other flange. The first protrusions and the second protrusions may be arranged at positions offset from each other in the direction from one flange toward the other flange.

With this construction, it is possible to improve uniformity in distance between the conducting wires 6 and 7 and between each turn of the set of conducting wires 6 and 7, thereby improving on uniformity in line-to-line capacitance of the conducting wires on the winding section.

While a common-mode choke coil has been described in detail with reference to specific embodiment thereof, it would be apparent to those skilled in the art that various modifications and variations may be made therein without departing from the spirit of the invention, the scope of which is defined by the attached claims.

What is claimed is:

1. A coil assembly comprising:

a core comprising a columnar winding section having a winding surface and both end, and flanges disposed on the both ends;

two conducting wires wound around the winding surface of the core; and electrodes disposed on the flanges of the core to be connected to the two conducting wires;

wherein the winding section has a plurality of protrusions protruding from the winding surface, the two conducting wires being wound about the winding surface so as to pass between neighboring protrusions while remaining separated from each other.

2. The coil assembly as claimed in claim 1, wherein one of the conducting wires contacts one of the neighboring protrusions, while the other of the conducting wires contacts the other of the neighboring protrusions.

3. The coil assembly as claimed in claim 1, wherein the plurality of protrusions are identical in shape.

4. The coil assembly as claimed in claim 1, wherein the plurality of protrusions are arrayed linearly at fixed intervals in a direction from one of the flanges toward the other of the flanges.

5. The coil assembly as claimed in claim 1, wherein the winding section has a polygonal cross-section and has a first surface; and wherein the plurality of protrusions include a plurality of first protrusions disposed on the first surface of the winding section, each of the first protrusions being identical in shape and arrayed linearly at fixed intervals in a direction from one of the flanges toward the other of the flanges.

6. The coil assembly as claimed in claim 5, wherein the winding section has a second surface;

and wherein the plurality of protrusions further include a plurality of second protrusions disposed on the second surface of the winding section, each of the second protrusions being identical in shape to each other and to the first protrusions and arrayed linearly at fixed intervals in a direction from one of the flanges toward the other of the flanges, the first protrusions and second protrusions being offset from each other in the direction from one of the flanges toward the other of the flanges.

7. The coil assembly as claimed in claim 1, wherein the plurality of protrusions each has a base end and a top end and are tapered so that a cross-sectional area of the base end is greater than a cross-sectional area of the top end eliminating an overhanging configuration.

8. The coil assembly as claimed in claim 1, wherein the two conducting wires are wound about the winding section at uniform intervals therebetween in a winding direction, and a set of two conducting wires is wound about the winding section at uniform intervals between each turn.

9. The coil assembly as claimed in claim 1, wherein the flanges comprise a first flange and a second flange;

wherein the two conducting wires comprise a first conducting wire and a second conducting wire;

wherein the electrodes comprise a first electrode disposed in the first flange and connected to one end of the first conducting wire, a second electrode disposed in the first flange and connected to one end of the second conducting wire, a third electrode disposed in the second flange and connected to another end of the second conducting wire, and a fourth electrode disposed in the second flange and connected to another end of the first conducting wire;

wherein provided that a direction in which the first and second conducting wires are wound is defined as a longitudinal direction, a direction connecting the first and second electrodes is defined as a first widthwise direction, and a direction orthogonal to the longitudinal direction and the first widthwise direction is defined as a first thickness direction, the winding section has a side surface extending in the first thickness direction and the longitudinal direction, and wherein the side surface is formed with a first notch at a position near the first flange and near the first electrode, the first notch extending entirely over the side surface in the thickness direction, the first conducing wire and the second conducting wire extending from the first electrode and the second electrode being disposed in the first notch side by side to start winding of the first and second conducting wires from the first notch.

10. The coil assembly as claimed in claim 9, wherein the first notch is formed along a junction between the winding section and the first flange.

11. The coil assembly as claimed in claim 9, wherein the first notch has a first corner on the first flange side and extending in the first thickness direction, and has a second corner on the side opposite the first flange side and extending in the first thickness direction;

wherein the first conducting wire extending from the first electrode extends along the first corner; and wherein the second conducting wire extending from the second electrode extends along the second corner.

12. The coil assembly as claimed in claim 9, wherein provided that a direction in which a direction connecting the third electrode and the fourth electrode is defined as a second widthwise direction, and a direction orthogonal to the longitudinal direction and the second widthwise direction is defined as a second thickness direction, the winding section has another side surface extending in the second thickness direction and the longitudinal direction, and wherein the another side surface is formed with a second notch at a position near the second flange and near the third electrode, the second notch extending entirely over the another side surface in the second thickness direction, the first conducing wire and the second conducting wire those wound over the winding section being disposed in the second notch side by side and connected to the fourth electrode and the third electrode, respectively.

13. The coil assembly as claimed in claim 12, wherein the second notch is formed along a junction between the winding section and the second flange.

14. The coil assembly as claimed in claim 12, wherein the second notch has a third corner on the second flange side and extending in the second thickness direction, and has a fourth corner on a side opposite the second flange and extending in the second thickness direction; and wherein a wire part near the another end of the second conducting wire extends along the third corner, and a wire part near the another end of the first conducting wire extends along the fourth corner.

15. The coil assembly as claimed in claim 14, wherein the first flange includes a first retaining part positioned directly downstream of the first electrode in the winding direction and a second retaining part positioned directly downstream of the second electrode in the winding direction and separated from the first retaining part in the first widthwise direction, the first conducting wire extending from the first electrode being engaged in the first retaining part and disposed along the first corner and the second conducting wire extending from the second electrode being engaged in the second retaining part and disposed along the second corner.

16. The coil assembly as claimed in claim 15, wherein the second flange includes a third retaining part positioned directly upstream of the third electrode in the winding direction and a fourth retaining part positioned directly upstream of the fourth electrode in the winding direction and separated from the third retaining part in the second widthwise, the second conducting wire extending from the third corner being engaged in the third retaining part and connected to the third electrode and the first conducting wire extending from the fourth corner being engaged in the fourth retaining part and connected to the fourth electrode.

* * * * *